US007896564B2

(12) United States Patent
Heaton et al.

(10) Patent No.: US 7,896,564 B2
(45) Date of Patent: Mar. 1, 2011

(54) PORTABLE PRINTER

(75) Inventors: Guy Heaton, Orange County, CA (US); Chad Gundlach, Orange County, CA (US)

(73) Assignee: Datamax-O'Neil Corporation, Orlando, FL (US)

( * ) Notice: Subject to any disclaimer, the term of this patent is extended or adjusted under 35 U.S.C. 154(b) by 678 days.

(21) Appl. No.: 11/985,779

(22) Filed: Nov. 16, 2007

(65) Prior Publication Data

US 2008/0152417 A1 Jun. 26, 2008

Related U.S. Application Data

(60) Provisional application No. 60/859,309, filed on Nov. 16, 2006.

(51) Int. Cl.
*B41J 3/36* (2006.01)
*B41J 29/13* (2006.01)
*B41J 29/00* (2006.01)

(52) U.S. Cl. ..... 400/88; 400/613; 400/693

(58) Field of Classification Search ..... 400/88, 400/613, 693

See application file for complete search history.

(56) References Cited

U.S. PATENT DOCUMENTS

| | | | | |
|---|---|---|---|---|
| 5,267,800 | A | 12/1993 | Petteruti et al. | |
| 5,290,639 | A * | 3/1994 | Mallory | 429/1 |
| 5,524,993 | A | 6/1996 | Durst | |
| 5,822,001 | A * | 10/1998 | Morikawa et al. | 348/375 |
| 5,997,193 | A | 12/1999 | Petterutti et al. | |
| 6,010,257 | A | 1/2000 | Petteruti et al. | |
| 6,364,550 | B1 | 4/2002 | Petteruti | |
| 6,428,227 | B2 * | 8/2002 | Petteruti et al. | 400/691 |
| 6,824,091 | B2 * | 11/2004 | Inana | 242/578.2 |
| 7,387,458 | B2 * | 6/2008 | Monteith et al. | 400/609 |
| 2004/0018420 | A1 * | 1/2004 | Nakajima et al. | 429/97 |
| 2006/0165467 | A1 * | 7/2006 | Kawakami et al. | 400/613 |
| 2006/0216098 | A1 * | 9/2006 | Lyman | 400/613 |

FOREIGN PATENT DOCUMENTS

| | | | |
|---|---|---|---|
| JP | 2000067834 A | * | 3/2000 |
| JP | 2000269655 A | * | 9/2000 |
| JP | 2005035180 A | * | 2/2005 |

OTHER PUBLICATIONS

O'Neil Product Development, Inc., O'Neil Quick Reference Programming Guide, O'Neil Products Development, Inc., 2006, 68 pages, O'Neil Product Development, Inc., Irvine, CA.

* cited by examiner

*Primary Examiner* — Daniel J Colilla

(74) *Attorney, Agent, or Firm* — Carter, DeLuca, Farrell & Schmidt, LLP

(57) ABSTRACT

A portable printer includes a housing having a cavity defined therein which supports a stock material for printing indicia thereon. The housing includes a power terminal which connects to a drive motor assembly configured to move the stock material through a paper path defined in the housing. A battery is loadable within the cavity and is movable from a first position spaced from the terminal to a second position in positive engagement with the terminal. A cover assembly is included which is pivotably supported on the housing and which is moveable from an open configuration for loading the stock material to a closed configuration to enable printing. The cover assembly includes a flexible print head mounted therein and a battery compartment having a ledge configured to operably engage the battery when the cover assembly is moved to the closed configuration to force the battery to the second position in positive engagement with the terminal.

16 Claims, 11 Drawing Sheets

PORTABLE PRINTER

CROSS REFERENCE TO RELATED APPLICATION

The present application claims the benefit of priority to U.S. Provisional Patent Application Ser. No. 60/859,309 filed on Nov. 16, 2006, the entire contents of which is incorporated by reference herein.

BACKGROUND

The present disclosure relates to portable printers and more particularly, the present disclosure relates to a portable label printer having a positively engaging battery locking system.

TECHNICAL FIELD

A portable printer is particularly suitable for printing onto stock material such as direct thermal media (DT media) which may include but is not necessarily limited to: labels, receipts, item labels, shelf labels/tags, ticket stubs, stickers, hang tags, price stickers, etc.). The stock material may be receipt paper, paper which is releasable attached to a web carrier (or label-stock) or paper which includes a roll of continuous label material without a web carrier (so-called "linerless stock"). In one type of linerless stock, the adhesive side of the strip is releasable from the face side of the next convolution of the roll, similar to a roll of adhesive tape. When unwound, linerless stock can be difficult to convey through a printer and may ultimately foul the device during use due to the build-up of transferred adhesive.

Portable printers are typically used in warehouses, on factory floors and in retail establishments for ticket printing and inventory control, e.g., car return establishments. Ideally, the printers weigh only a few pounds and are small enough to be easily carried during use and/or easily attached to a belt or a harness-type device. This enables the user to print labels or receipts on demand without having to retrieve the printed label from a printing station. Because the printer is portable, the printer communicates with a host terminal or network connection via radio or optical interface and therefore does not require a cable connection.

One noted issue with some portable printers is the use of an externally attached battery, externally accessible battery, or battery pack to power the device which adds undesirable weight and size to the portable printer. To resolve this issue, some manufacturers have developed printers configured to use an internal battery housed within the portable printer housing. Problems may arise, however, during normal or sometimes rough handling of the device since the battery connection may become easily dislodged. Conversely, providing too tight a battery connection may pose problems for the user when loading, recharging and/or replacing the battery.

As a result, it would therefore be desirous to provide a portable printer which provides both an enhanced battery connection and which is easily loadable and unloadable from the printer for replacement or recharging purposes.

SUMMARY

The present disclosure relates to a portable printer including a housing having a cavity defined therein which supports a stock material (e.g., direct thermal media such as a roll of linerless paper, label or receipt paper) for printing indicia thereon. The housing includes a power terminal which connects to a drive motor assembly configured to move the stock material through a paper path defined in the housing. A pair of stanchions may be included which releasably support the stock material. A battery is selectively loadable within a first battery compartment disposed in the cavity. The battery is movable from a first position relatively spaced from the terminal to a second position in positive engagement with the terminal.

A cover assembly is included which is pivotably supported on the housing and which is moveable from an open configuration for loading the stock material to a closed configuration to enable printing. The cover assembly includes a flexible print head mounted therein and a second battery compartment. The flexible print head may be releasably mounted to or slidingly engageable with the cover assembly to facilitate assembly or replacement. The second battery compartment has a ledge defined therein configured to operably engage the battery when the cover assembly is moved to the closed configuration to force the battery to the second position in positive engagement with the terminal.

In one embodiment, the printer includes a release mechanism operably coupled to the housing and engageable with the cover assembly when the cover assembly is moved to the closed configuration. The release mechanism may be configured to include a pair of catches which mechanically engage a corresponding pair of mechanical interfaces on the cover assembly to secure the cover assembly relative to the housing.

In another embodiment, a platen roller is included which is operably coupled to the drive assembly. The platen roller may be made from a material which actively pulls or drags the stock material from the roll through the paper path. When linerless paper is utilized, the platen roller may be made from a material which does not adhere to the linerless paper when printing.

In still another embodiment, the housing may include a housing tray insertable within the cavity of the housing. The housing tray includes a lip at a front end thereof having a series of raised ridges which guide the stock material along the paper path. The raised ridges may be configured to reduce the contact area of the lip with the paper to facilitate conveyance of the stock material along the paper path.

In yet another embodiment, the lip includes a sensor disposed therein which is configured to regulate and/or monitor printing functions and parameters and relay information relating to thereto back to an internally-disposed PC board and/or remote network connection. The printing functions and parameters may be selected from the group consisting of stock material speed, "out of stock material" alert, "low stock material" alert, stock material thickness, stock material malfunction, printing malfunction, print speed, cover configuration, print head temperature and combinations thereof.

The present disclosure also relates to a portable printer having housing including a cavity defined therein which supports a stock material for printing indicia thereon. The housing includes a power terminal which connects to a drive motor assembly configured to move the stock material through a paper path defined in the housing. A battery is selectively loadable in the cavity and slideable from a first position being spaced from the terminal to a second position in positive engagement with the terminal.

A cover assembly is included which is pivotably supported on the housing and moveable from an open configuration for loading the stock material to a closed configuration to enable printing. The cover assembly includes a flexible print head mounted therein and a battery compartment. The battery compartment has a ledge defined therein configured to operably engage the battery when the cover assembly is moved to the closed configuration to force the battery to the second position in positive engagement with the terminal. A sensor is included which is disposed in the housing and which is configured to regulate and monitor information and relay the information back to an internally-disposed PC board and/or a remote network connection. The information may relate to: stock material speed, "out of stock material" alert, "low stock material" alert, stock material thickness, stock material malfunction, printing malfunction, print speed, cover configuration, print head temperature and combinations thereof.

BRIEF DESCRIPTION OF THE DRAWINGS

Various embodiments of the subject instrument are described herein with reference to the drawings wherein.

DETAILED DESCRIPTION

Figure 1:
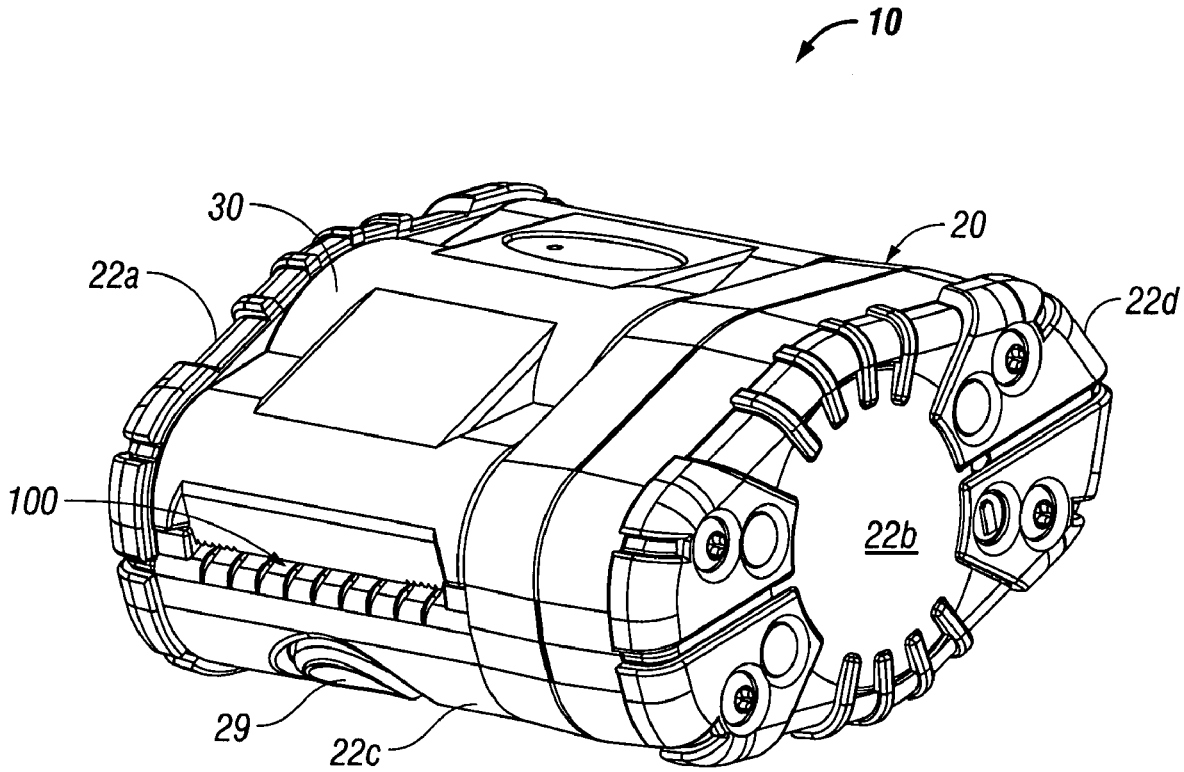
FIG. 1 is a front perspective view of a portable label printer in accordance with one embodiment of the present disclosure.
Figure 2A:
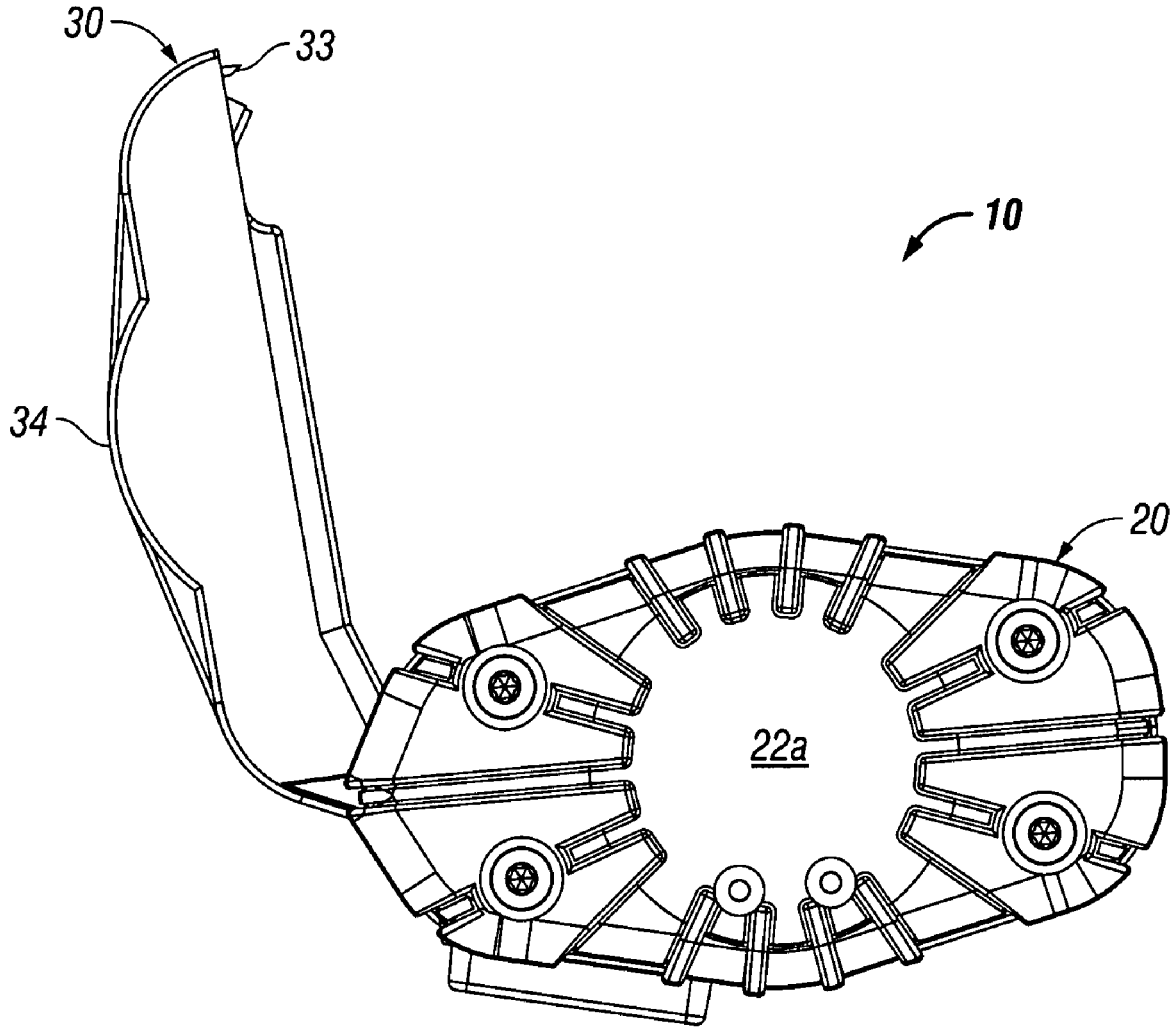
FIG. 2A is a left, side view of the printer of FIG. 1 shown in an open configuration.
Figure 2B:
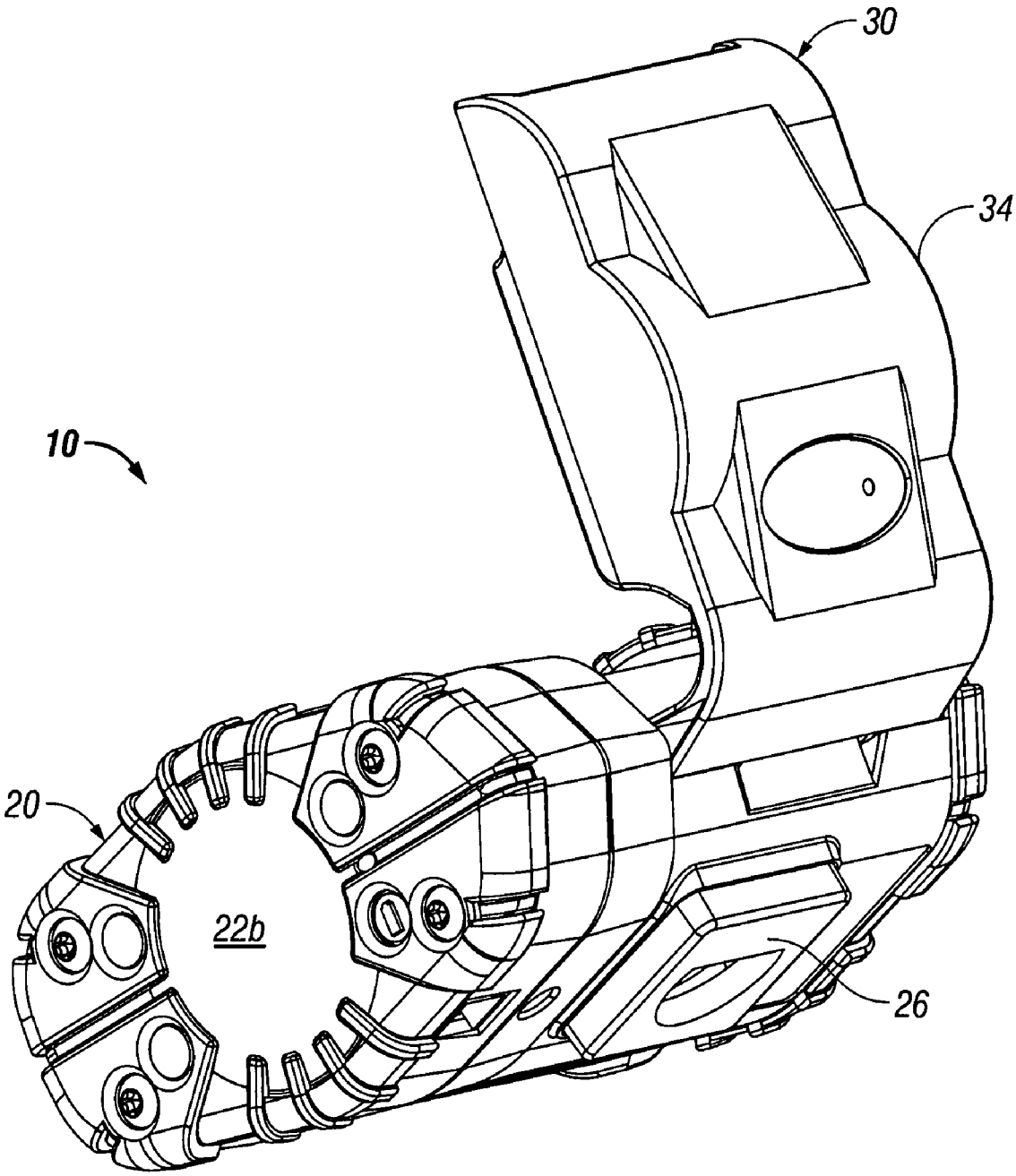
FIG. 2B is a rear perspective view of the printer of FIG. 1 shown in an open configuration.
Figure 3:
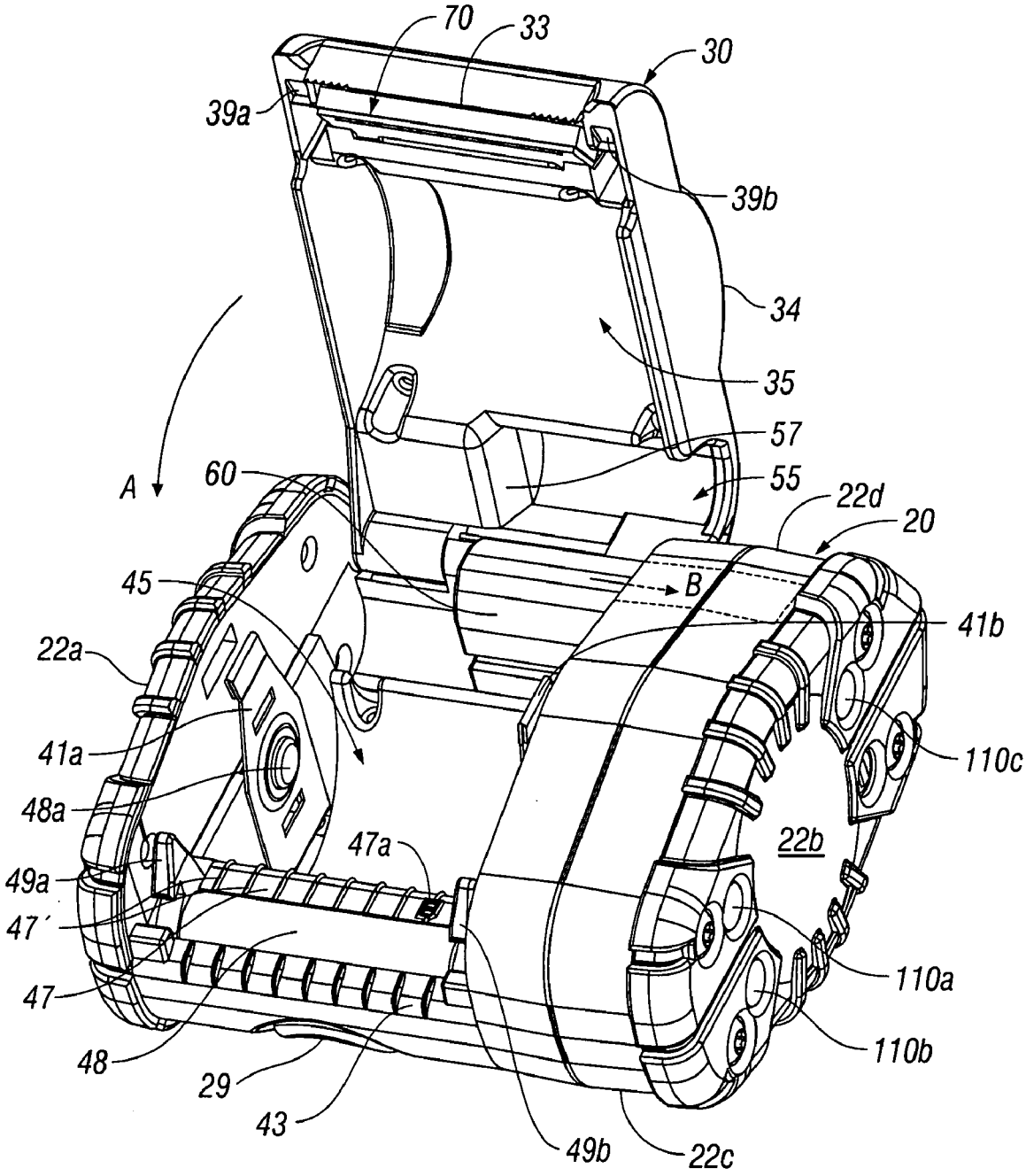
FIG. 3 is a front perspective view of the printer of FIG. 1 shown in an open configuration.
Figure 4:
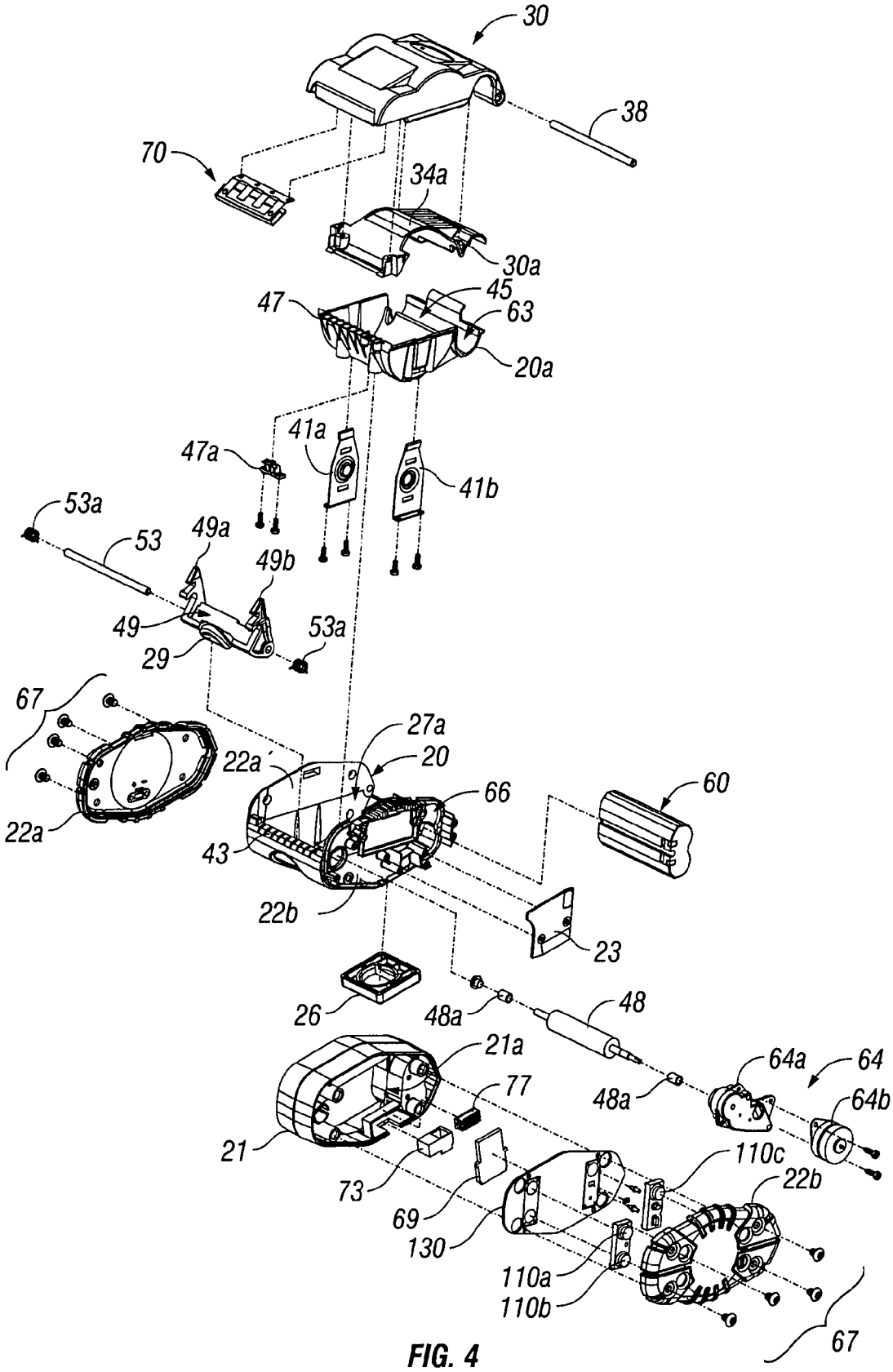
FIG. 4 is a perspective view of the printer of FIG. 1 with parts separated.

Turning now in detail to FIGS. 1-7 which show the operating features and intercooperating components of the portable printer generally identified as printer 10. Printer 10 includes a housing 20 defined by sides 22*a* and 22*b*, front 22*c* and rear 22*d* and a selectively openable cover 30 for accessing the internal operating components of the housing 20. As best seen in FIGS. 3 and 4, housing 20 also includes a bottom tray 20*a* which defines a cavity 45 configured and dimensioned to receive a roll of stock material (not shown) for printing indicia thereon. As used herein, the term "stock material" refers to any type of paper used for printing purposes such as direct thermal media used for printing receipts, labels, hang tags, merchandise information, etc.

Figure 6:
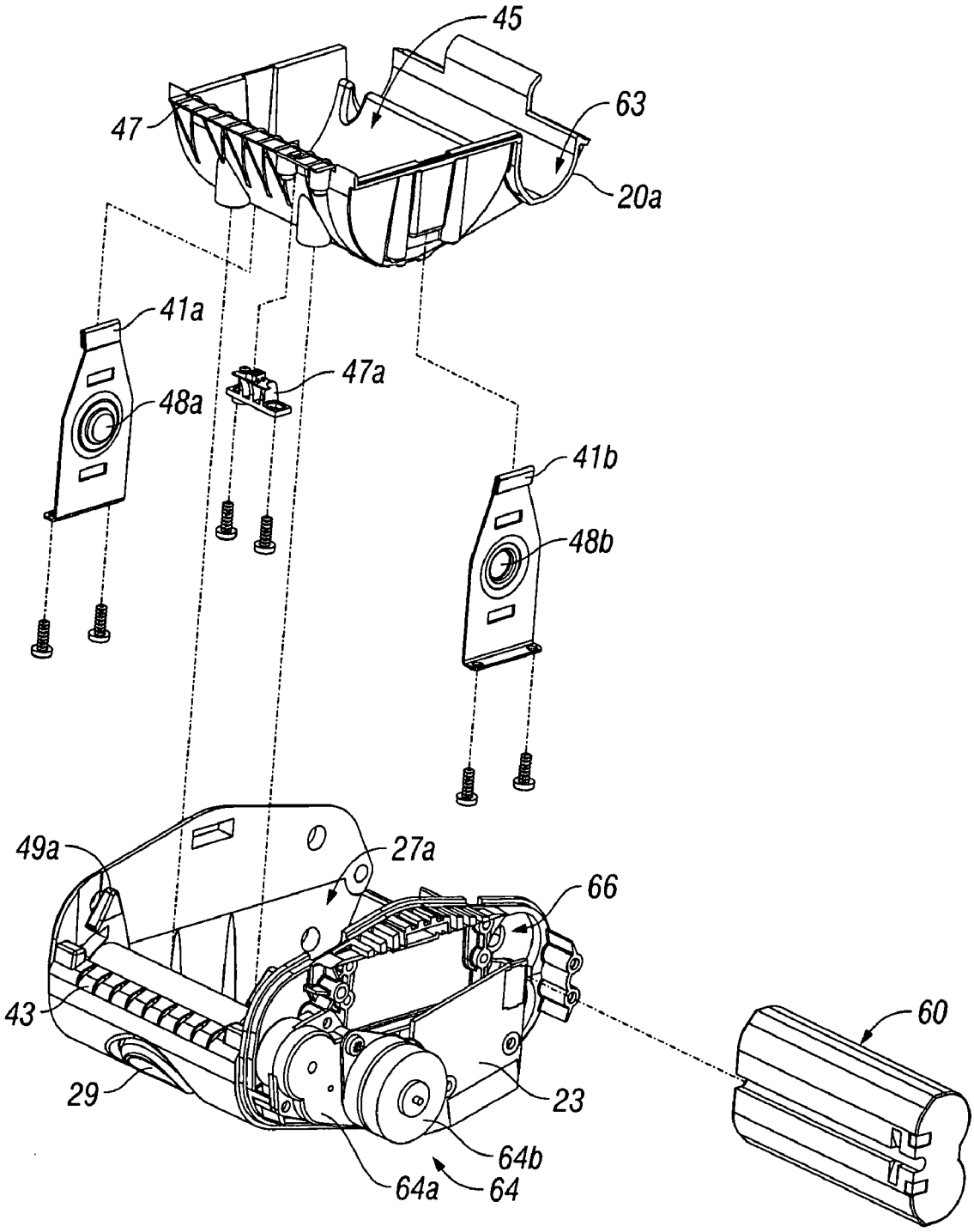
FIG. 6 is an enlarged, perspective view with parts separated showing a housing tray engageable with the housing, media support stanchions and a battery for use with the printer according to the present disclosure.

More particularly, housing tray 20*a* includes a pair of generally flexible media stanchions 41*a* and 41*b* configured to releasably and rotatingly mount the stock material between posts 41*a* and 41*b* (See FIG. 6). Housing tray 20*a* also includes a battery slot 63 which is configured to slideably retain a battery 60 that supplies operating power to the printer 10. The front of the housing tray 20*a* includes a lip 47 made from an elastomeric material. The lip 47 includes a plurality of raised ridges 47' designed to reduce the overall area contact with the stock material, in particular, linerless stock, as the stock material is being advanced from the roll through the paper path 100 to prevent sticking and jamming. It is envisioned that the lip 47 may also include a non-stick coating which prevents adherence to the stock material as the stock material is being advanced through the paper path 100.

As best shown in FIG. 4, housing tray 20*a* fits within a cavity 27*a* defined within housing 20 by sides 22*a'* and 22*b'* such that lip 47 generally aligns with a corresponding lip 43 disposed on front 22*c* of housing 20. Housing 20 also includes a locking and release mechanism 49 which is disposed within the front 22*c* of housing 20 about a pivot bar 53. Locking and release mechanism 53 includes catches 49*a* and 49*b* which operatively engage corresponding interfaces 39*a* and 39*b* in cover 30 to secure the inner-working components therein (e.g., battery 60, stock, etc.). A locking release 29, when depressed, pivots release mechanism 53 and disengages catches 49*a* and 49*b* from corresponding interfaces 39*a* and 39*b* to open the cover 30. One or more springs 53*a* are used to bias the cover 30 in an open configuration and to facilitate engagement of the mechanically cooperating locking components 49*a*, 49*b* and 39*a*, 39*b*, respectively.

The sides 22*a* and 22*b* of housing 20 are mounted to respective side 22*a'* and spacer 21 by one or more mechanical interfaces 67. Sides 22*a* and 22*b* may include various rubbers and other elastomeric components to protect the printer 10 during handling. A mounting clip 26 is also included and attached to the housing 20 which enables a user to mount the printer 10 to a belt or mechanical attachment on a belt loop. A battery aperture or slot 66 is defined in side 22*b'* and aligns with battery slot 63 in tray 20*a*. Battery aperture 66 also aligns with a terminal 21*b* disposed in spacer block 21 as discussed in more detail below. Battery aperture 66 may be dimensioned such that the battery 60 may only be inserted therein in one orientation to facilitate accurate loading. Battery aperture 66 may also include one or more interfaces which align with corresponding interfaces on the battery 60 to guide, secure and maintain the battery 60 in tight association within terminal 21*b* and to assure electrical continuity during handling and use.

Cover 30 includes an internal tray 30*a* which defines a cavity 35 dimensioned to house the roll of stock (not shown) when closed. One or more contours 34 and 34*a* are provided on the cover 30 and the tray 30*a*, respectively, to stabilize the roll of stock material during rotation thereof. Cover 30 also includes a tear strip 33 disposed at the front thereof that is configured to allow a user to easily tear a strip of stock material from the remaining roll after a label or receipt, or other media has been printed. As best shown in FIGS. 3 and 4, the cover tray 30*a* also includes a cover battery compartment 55 defined therein which is dimensioned to releasably and slideably secure battery 60. Cover battery compartment 55 includes a ledge 57 which is configured to force the battery 60 in the direction of arrow "B" when the cover 30 is closed in the direction of arrow "A". As can be appreciated by the present disclosure, the closing of cover 30 forces the battery 60 into positive electrical and mechanical engagement within terminal 21*b* disposed in spacer block 21 which provides secure and consistent power to the various internal electrical connections associated with the printer 10.

A flexible print head 70 is located within the cover 30 and is configured to thermally imprint indicia onto the stock material as the stock material is advanced through the paper path 100. More particularly, print head 70 mounts within cover 30 between interfaces 39*a* and 39*b* in substantial vertical registration with platen roller 48. Flexible print head 70 is a non-floating type printing head which is configured to be fixed along the X, Y axes and movable in the Z axis only (i.e., movable relative to the platen roller 48). The print head 70 is powered by battery 60 and cooperates with one or more sensors 47*a* disposed in lip 47 of housing tray 20*a* or cover assembly 30 or tray 30*a*.

The sensor 47*a* and the flexible print head 70 electrically communicate to regulate printing and alert the user of when the roll of stock is empty. The sensor 47*a* may also be configured to regulate or monitor other printing functions and/or parameters and relay such information back to an internally-disposed printed circuit board (PCBA) 130 or a remote networking connection (not shown) via a transceiver module 69. Other printer functions and/or parameters may include: paper speed, paper thickness, paper malfunction, "out of stock material" alert, "low stock material" alert, printing malfunction, print speed, cover configuration (i.e., open/closed), the temperature of the print head 70, etc. One or more additional PCBA boards (not shown) may be utilized to monitor one or more of these functions.

Figure 5:
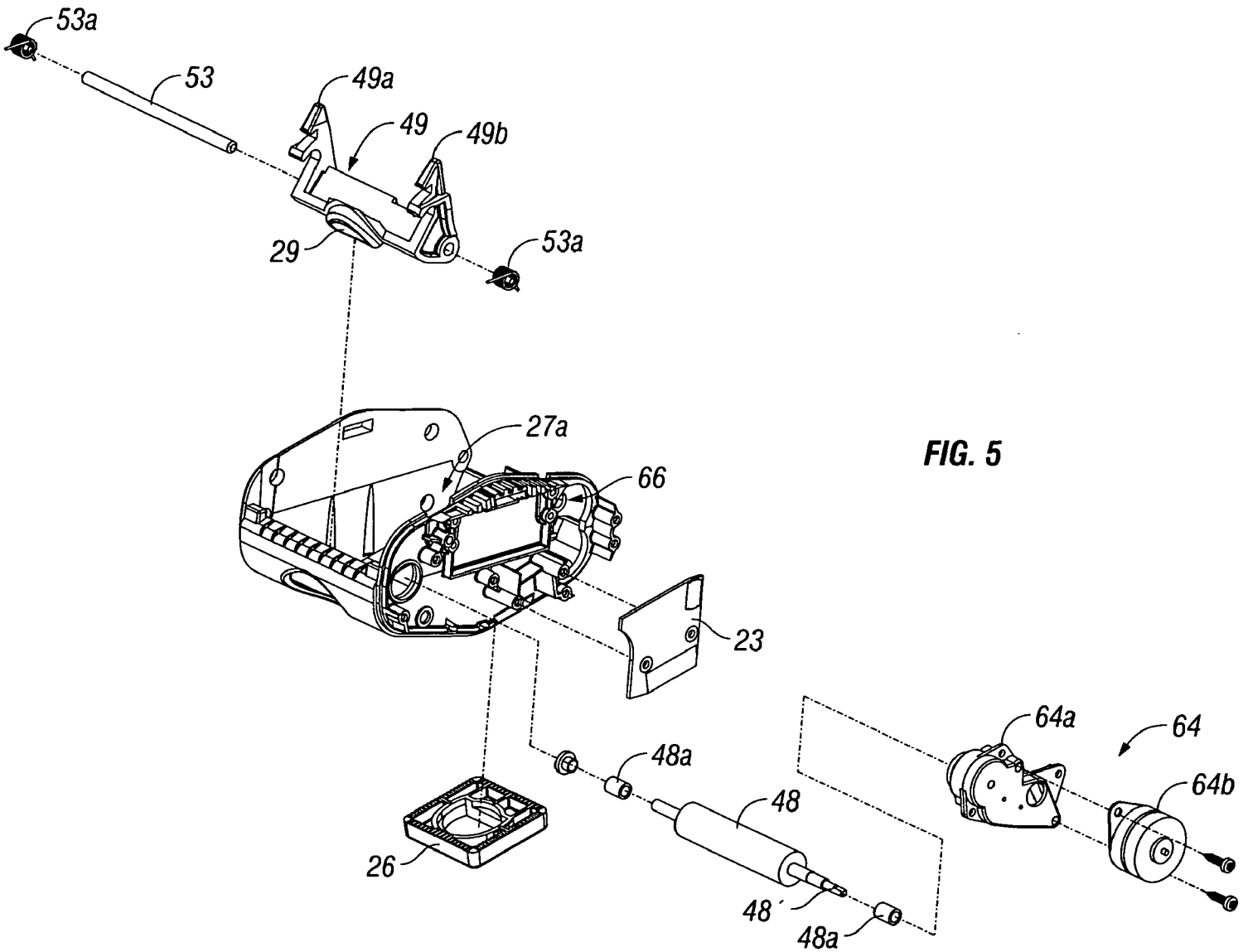
FIG. 5 is an enlarged, perspective view with parts separated showing a housing, release assembly and motor assembly for use with the printer according to the present disclosure.
Figure 7:
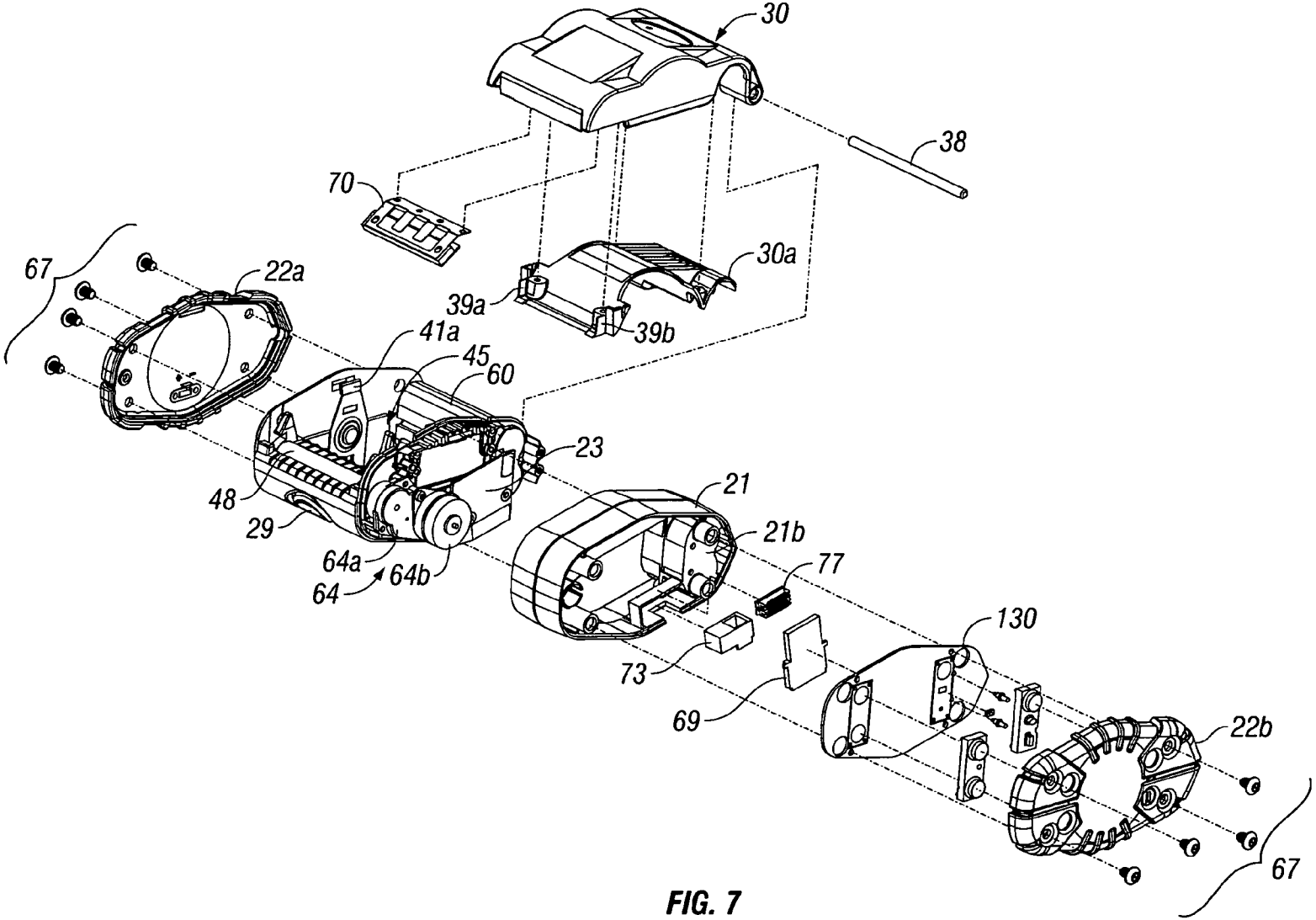
FIG. 7 is an enlarged, perspective view with parts separated showing a spacer block, side plates and a cover assembly which are engageable with the housing for use with the printer according to the present disclosure.

As best shown in FIGS. 5-7, platen roller 48 is configured to advance the stock material through the paper path 100. As such, the platen roller 48 is designed to include a surface material designed to both grab and advance the stock from the roll and through the paper path 100 but which is generally non-adhereable to the stock material especially when utilizing a linerless stock.

A pair of bushings 48*a* is included to mount the platen 48 in the housing 20. One end of the platen 48 includes a keyed interface 48' which mates with a corresponding interface (not shown) on a drive motor assembly 64 which drives the platen 48 to advance the stock material from the roll. Drive motor assembly 64 is configured to securely mount against side 22*b*' and electrically interface with a battery plate 23 and battery 60. A battery charging plate may be operatively coupled to the PCBA 130 and is configured to manage or regulate the battery level and/or regulate the charging operation of the battery 60 when the printer 10 is engaged to a docking station or connected to a remote power source.

Drive motor assembly 64 consists of a two-part stepper motor including components 64*a* and 64*b* which cooperate to drive the platen 48. Other types of drive assemblies are also envisioned as known in the art and may include variable-speed motors, single-speed motors, AC Motors, DC Motors, brushless DC Motors, servo motors, brushed DC servo motors, brushless AC servo motors, stepper motors, linear motors, etc. Internally-disposed gearing (not shown) may also be included in the motor components 64*a* and 64*b* to regulate the rotational speed of the platen 48 as needed to advance the stock.

Figure 8A:
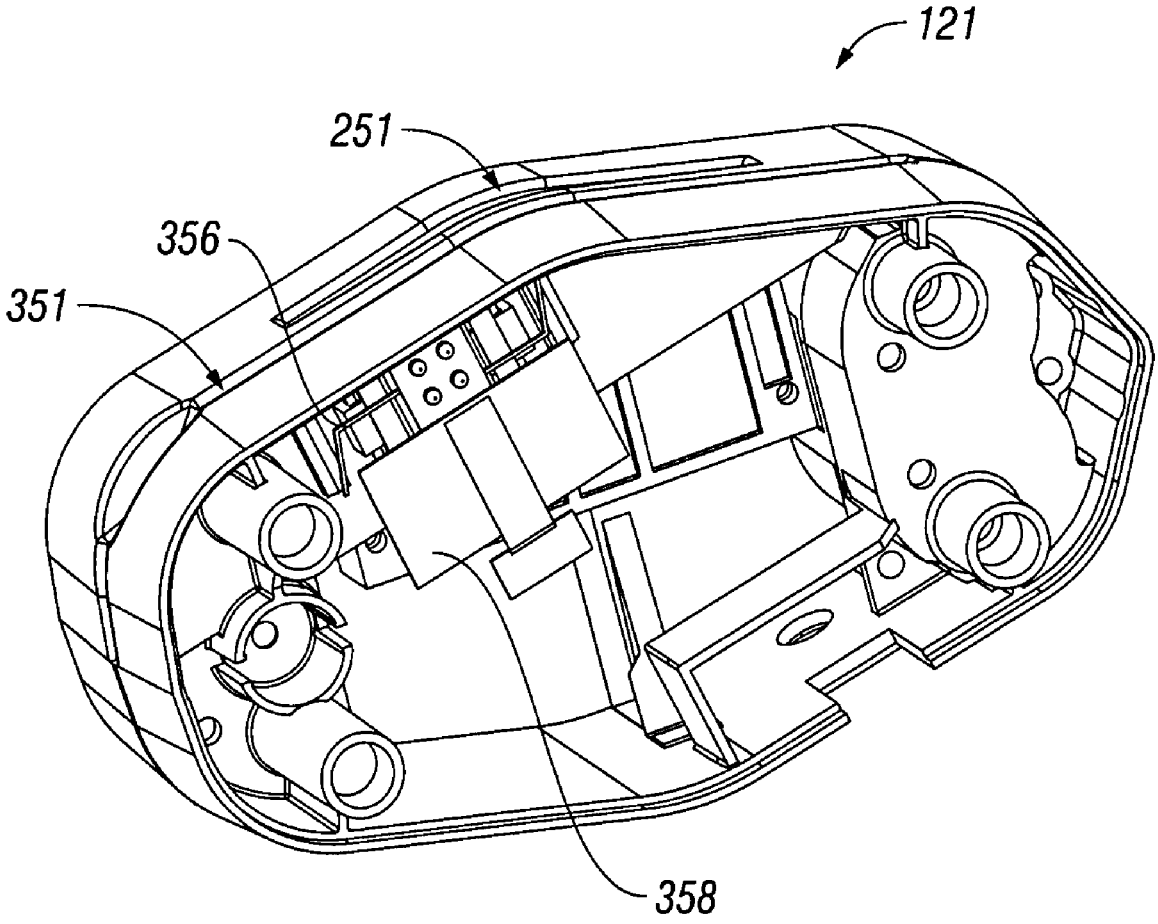
FIG. 8A is an enlarged, left perspective view of an option block for use with the printer according to the present disclosure.
Figure 8B:
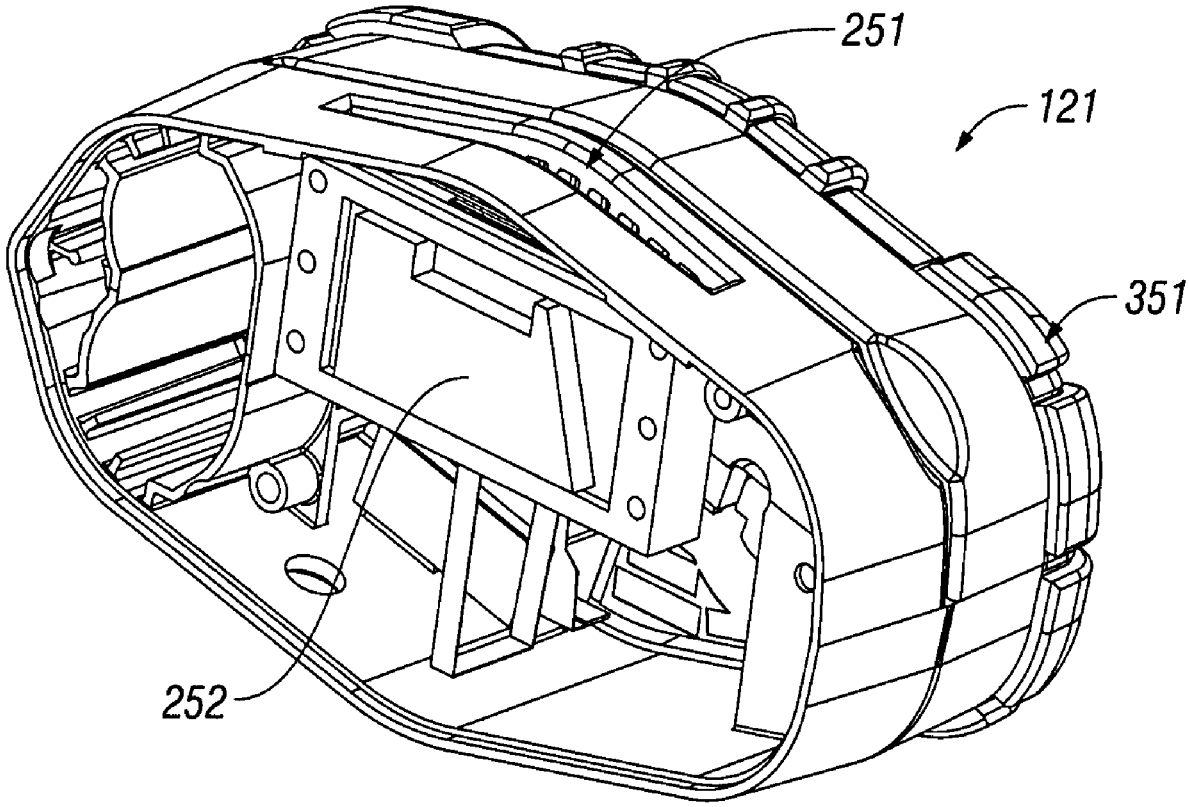
FIG. 8B is an enlarged, right perspective view of an option block for use with the printer according to the present disclosure.
Figure 8C:
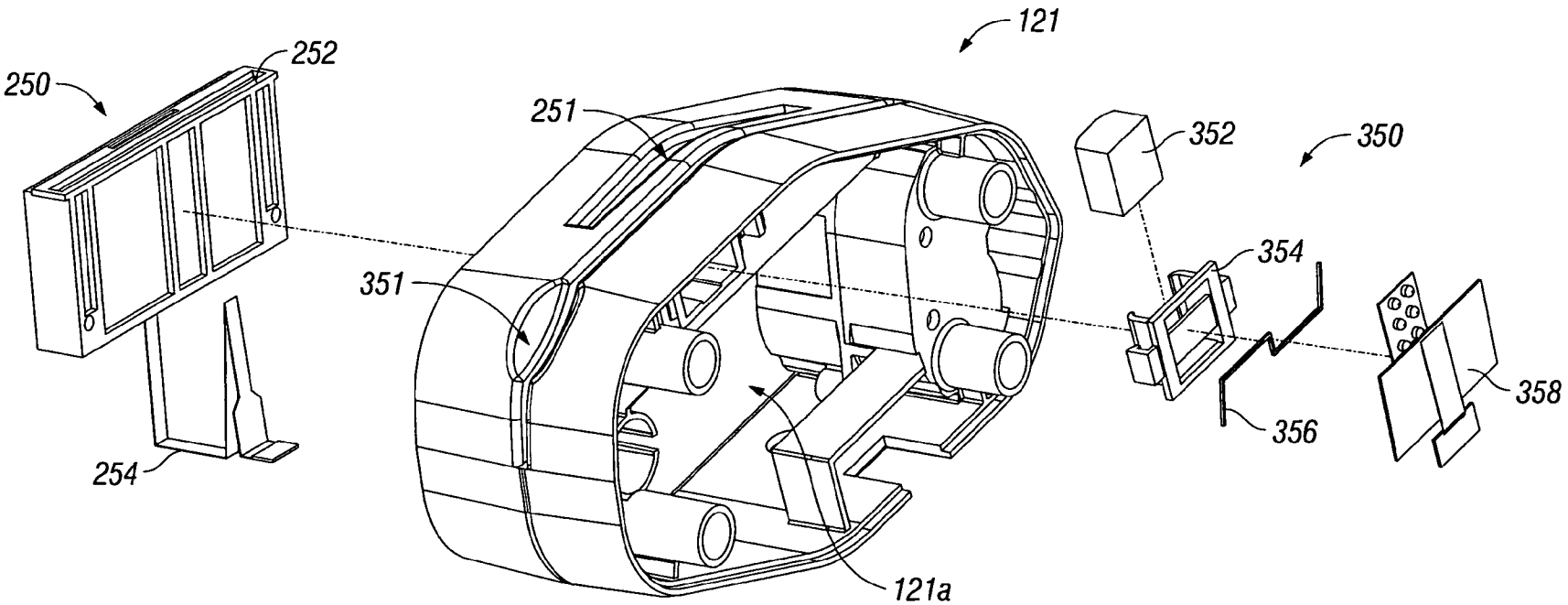
FIG. 8C is an enlarged, perspective view with parts separated showing an optional smart card reader and magnetic card reader for use with the printer according to the present disclosure.

A spacer block or option block 21 is disposed between sides 22*b* and 22*b*' of the housing 20. Spacer block 21 includes an internal cavity 21*a* defined therein that is configured to house drive motor assembly 64, PCBA 130 and other electrical components described below. As best shown in FIGS. 8A-8C, the spacer block 21 may be replaced with an option block 121 which includes a smart card reader/writer 250 or a magnetic card reader/writer 350. Other types of readers are also contemplated, RFID readers, barcode scanners, Aztec Code scanners, etc. As can be appreciated, during manufacturing and assembly, the user indicates what type of reader is desirable and simply mounts that particular reader in place of the spacer block 21. This greatly facilitates assembly. In addition, combination readers may also be substituted for the spacer block 21, e.g., a magnetic card reader 350 and smart card reader 250 or any other combination of the above-mentioned readers.

PCBA 130 is also housed within spacer block cavity 21*a* and is configured to control the operation of the printer 10 and print head 70 and regulate the charging of the battery. As mentioned above, the PCBA 130 may also be configured to control or monitor various other functions and/or parameters of the printer 10 such as paper speed, paper thickness, paper malfunction, printing malfunction, print speed, cover configuration (i.e., open/closed), the temperature of the print head 70, etc. A wireless transceiver 69 electrical couples to the PCBA 130 and is dimensioned to receive and transmit data and/or operating instructions from a remote networking connection (not shown). Various electrical controls 110*a*-110*c* are positioned on side 22*b* of the housing and configured to electro-mechanically communicate with the PCBA 130 to allow user input and printer control.

In operation, the user actuates the release lock 29 to unlock the cover 30 with respect to the housing 20. A roll of stock material is loaded and engaged for rotation between stanchions 41*a* and 41*b*. An edge of the stock material is pulled over lips 47 and 43. The battery 60 is loaded within battery compartment 63 and pushed in the direction of arrow "B". The user then closes the cover 30 which locks with the housing by virtue of locking release mechanism 49. As the cover is closed, the ledge 57 of the cover battery compartment 55 in cover 30 forces the battery 60 into positive engagement within terminal 21*b* to power the internal electrical connections disposed in the housing 20. Closing the cover 30 also aligns the stock material in vertical registration with the print head 70.

Moreover, closing the cover 30 also prevents the stanchions 41*a* and 41*b* from moving outwardly (i.e., away from one another) to maintain the stock material secure within the cover 30. The stanchions 41*a* and 41*b* may include one or more mechanical interfaces (e.g., tongues) which operably cooperate and interface with corresponding mechanical interfaces (e.g., grooves) in the cover 30 to secure the stanchions 41*a* and 41*b* in place when the cover 30 is closed. As can be appreciated, this insures that the stanchions 41*a* and 41*b* do not accidentally open potentially dislodging the stock material during handling. Roll supports 48*a* and 48*b* may be included which support the roll of stock material for rotational purposes.

Once the cover 30 is closed, the user then turns the printer 10 to "wake" from a "sleep mode" by actuating one of the controls, e.g., 110*a*, on the side 22*b* of the housing 20. The printer 10 may be configured to go through a series of start-up tests before readying for printing, e.g., the PCBA 130 queries the sensor 47*a* (or other sensors not shown) whether stock material is loaded and properly positioned within the printer 10 prior to allowing printing to commence. Other tests may also be performed such as querying the network host for instructions or configuration settings. The PCBA 130 may also include various subroutines and algorithms which control, inter alia, the printing speed and/or print output of the printer.

To unload or replace the battery 60 from the housing 20, the user simply grasps the exposed end of the battery 60 and tilts the exposed end towards the terminal 21*b*. This disengages the battery 60 from the terminal 21*b* and allows the battery 60 to be pulled or slid out of the housing 20 for replacement purposes.

The printer 10 communicates with the host computer or network connection to enable printing. As such, various instructions and data are transmitted to the PCBA 130 and the operator may selectively initiate printing as desired, or alternatively, the host or network connection may initiate printing remotely. The printer 10 may also transmit information (e.g., configuration setting, operating parameters, etc.) back to the host computer or network connection via transceiver module 69. When inactive, the printer 10 is designed to power down to a so-called "sleep mode" and essentially "wake up" when any radiofrequency signal is received from the network connection, the user initiates a print command or one or more of the electrical controls is activated. The printer 10 may also be configured to awake on the reception of another type of signal, RFID signal, RS232 signal, infrared signal (IRdA), Bluetooth signal, USB signal, etc. As can be appreciated, the various components relative to these different communication elements may be included as required to allow the printer 10 to operate in this fashion. For example, one envisioned printer includes a USB or data port 73 which electrically connects to the PCBA 130 to allow communication between the printer and one or more external devices. One or more flexible connectors 77 may be utilized to provide electrical continuity among the various electrical components.

As mentioned above, FIGS. 8A-8C show one envisioned embodiment wherein an option block 121 may be used to replace the spacer block 21. FIGS. 8A-8C actually show a combination option block 121 which employs both a smart card reader 250 and a magnetic card reader 350 therein. It is contemplated that option block 121 may be configured to only include the smart card reader 250 or the magnetic card reader 350 or both. Optionally, the option block 121 may be sold as shown with only the smart card reader 250 including the electronic components disposed therein or, likewise, the magnetic card reader 350 may be sold in the same fashion.

As best shown FIG. 8C, option block 121 includes both the smart card reader 250 and the magnetic card reader 350. Smart card reader is disposed within cavity 121*a* defined in option block 121 and includes a reader 252 which electrically communicates with PCBA 130. A clip or flexible cable connection 254 may be included which electrically couples to the PCBA board 130. Smart card reader 250 when disposed in cavity 121*a* aligns in an offset fashion with a slot 251 defined in option block 121 thereby allowing a user to insert a smart card (not shown) into slot 251 for reading and/or writing purposes.

Magnetic card reader 350 includes a read/write head 352 which mounts within cavity 121*a* by way of a clip 354. A flexible cable connect 358 is operatively coupled to the clip 354 and configured for electrically communication with head 352. A spring clip 356 may be utilized to facilitate mounting the magnetic card reader 350 within cavity 121*a*. Magnetic card reader 350 when disposed in cavity 121*a* aligns in an offset fashion with a slot 351 defined in option block 121 thereby allowing a user to insert a card (not shown) into slot 351 for reading and/or writing purposes.

From the foregoing and with reference to the various figure drawings, those skilled in the art will appreciate that certain modifications can also be made to the present disclosure without departing from the scope of the same. For example, it is envisioned that the cover 30 and cover tray 30*a* may be partially translucent to allow a user to visually inspect the stock for replacement purposes. The flexible print head 70 may be engaged in a snap-fit or slide-fit manner within the cover 30 to allow replacement thereof in the case of a malfunction. Sensor 47*a* (or another sensor (not shown) may be operably coupled to the print head 70 to alert a user of abnormal print head 70 condition for replacement purposes.

In another embodiment, the stock material may include an indicator included therewith which is configured to communicate with the sensor 47*a* to alert the user prior to an "out of stock material" or "low stock material" alert. For example, the last couple of revolutions of the roll may be constructed from a different stock material, a different color stock material or a different thickness stock material which is easily sensed by the sensor 47*a* to alert the user of a low stock condition.

The printer may also include one or more terminals which allow the printer to electrically couple to a docking station for charging purposes or to retrieve data from a terminal.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed:

1. A portable printer comprising:

at least one spacer block or option block, wherein the spacer block or the option block has an internal cavity defined therein adapted to house a drive motor assembly;

a housing having a cavity defined therein which supports a stock material for printing indicia thereon, the housing including:

a power terminal which connects to the drive motor assembly configured to move the stock material through a paper path defined in the housing; and a portion configured to selectively receive the spacer block or the option block;

a battery loadable within a first battery compartment disposed in the cavity and movable from a first position being spaced from the terminal to a second position in positive engagement with the terminal; and a cover assembly pivotably supported on the housing an moveable from an open configuration for loading the stock material to a closed configuration to enable printing, the cover assembly including:

a print head mounted therein configured to imprint indicia onto the stock material;

a second battery compartment including a ledge defined therein configured to operably engage the battery when the cover assembly is moved to the closed configuration to force the battery to the second position in positive engagement with the terminal.

2. A portable printer according to claim 1 wherein the cover assembly is contoured to accommodate a roll of stock material.

3. A portable printer according to claim 1 further comprising a release mechanism operably coupled to the housing and engageable with the cover assembly when the cover assembly is moved to the closed configuration.

4. A portable printer according to claim 3 wherein the release mechanism includes a pair of catches which mechanically engage a corresponding pair of mechanical interfaces on the cover assembly to secure the cover assembly relative to the housing.

5. A portable printer according to claim 1 wherein the portable printer further comprises a platen roller operably coupled to the drive assembly, the platen roller being made from a material which pulls the stock material through the paper path.

6. A portable printer according to claim 1 wherein the housing includes a housing tray insertable within the cavity of the housing, the housing tray including a lip at a front end thereof, the lip having a series of raised ridges which guide the stock material along the paper path.

7. A portable printer according to claim 6 wherein the raised ridges are configured to reduce the contact area of the lip with a roll of stock material to facilitate conveyance of the stock material along the paper path.

8. A portable printer according to claim 6 wherein the lip includes a sensor disposed therein, the sensor being configured to at least one of regulate and monitor printing functions and parameters.

9. A portable printer according to claim 8 wherein the sensor is configured to relay information relating to printing functions and parameters back to at least one of an internally-disposed PC board and remote network connection.

10. A portable printer according to claim 8 wherein the printing functions and parameters are selected from the group consisting of stock material speed, out of stock material alert, low stock material alert, stock material thickness, stock material malfunction, printing malfunction, print speed, cover configuration, print head temperature and combinations thereof.

11. A portable printer according to claim 1 wherein the flexible print head is releasably mounted to the cover assembly.

12. A portable printer according to claim 1 further comprising a pair of stanchions which releasably support the stock material.

13. A portable printer according to claim 12 wherein the stanchions each include a mechanical interface which is adapted to operably engage with the cover assembly to maintain the stock material between the stanchions when the cover assembly is moved to the closed configuration.

14. A portable, printer according to claim 1, wherein the option block includes at least one of a smart card reader, a magnetic card reader, an RFID a reader, a barcode scanner, or an Aztec scanner.

15. A portable printer comprising:

at least one spacer block or option block, wherein the spacer block or the option block has an internal cavity defined therein adapted to house a drive motor assembly;

a housing having a cavity defined therein which supports a stock material for printing indicia thereon, the housing including:

a power terminal which connects to the drive motor assembly configured to move the stock material through a paper path defined in the housing; and a portion configured to selectively receive the spacer block or the option block;

a battery loadable within a first battery compartment disposed in the cavity and movable from a first position being spaced from the terminal to a second position in positive engagement with the terminal;

a cover assembly pivotably supported on the housing an moveable from an open configuration for loading the stock material to a closed configuration to enable printing, the cover assembly including:

a print head mounted therein configured to imprint indicia onto the stock material;

a second battery compartment including a ledge defined therein configured to operably engage the battery when the cover assembly is moved to the closed configuration to force the battery to the second position in positive engagement with the terminal; and a sensor disposed in the housing, the sensor being configured to at least one of regulate and monitor information and relay the information back to at least one of an internally-disposed PC board and remote network connection, the information selected from the group consisting of stock material speed, out of stock material alert, low stock material alert, stock material thickness, stock material malfunction, printing malfunction, print speed, cover configuration, print head temperature and combinations thereof.

16. A portable printer according to claim 15, wherein the option block includes at least one of a smart card reader, a magnetic card reader, an RFID a reader, a barcode scanner, or an Aztec scanner.

* * * * *